US009951457B2

(12) United States Patent
Hunnell et al.

(10) Patent No.: US 9,951,457 B2
(45) Date of Patent: Apr. 24, 2018

(54) LAUNDRY TREATING APPLIANCE WITH A TUB RING

(71) Applicant: Whirlpool Corporation, Benton Harbor, MI (US)

(72) Inventors: John M. Hunnell, Saint Joseph, MI (US); Pradeep Kumar, Faridabad (IN); Brenner M. Sharp, Bridgman, MI (US); Christine L. Strain, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 149 days.

(21) Appl. No.: 14/639,457

(22) Filed: Mar. 5, 2015

(65) Prior Publication Data

US 2016/0258103 A1 Sep. 8, 2016

(51) Int. Cl.
*D06F 37/26* (2006.01)

(52) U.S. Cl.
CPC ..... *D06F 37/264* (2013.01); *D06F 37/26* (2013.01); *D06F 37/267* (2013.01)

(58) Field of Classification Search
CPC ..... D06F 37/264; D06F 37/267; D06F 37/26
See application file for complete search history.

(56) References Cited

U.S. PATENT DOCUMENTS

| | | | |
|---|---|---|---|
| 5,582,039 | A | 12/1996 | Mueller et al. |
| 6,351,974 | B1 | 3/2002 | Lyu et al. |
| 6,668,410 | B2 | 12/2003 | Lyu et al. |
| 7,263,862 | B2 | 9/2007 | Lyu et al. |
| 7,263,864 | B2 | 9/2007 | Lyu et al. |
| 2010/0126236 | A1 | 5/2010 | Seo et al. |
| 2011/0247373 | A1 | 10/2011 | Sharp |

FOREIGN PATENT DOCUMENTS

| | | | |
|---|---|---|---|
| CN | 201864968 | U | 6/2011 |
| JP | 07275565 | A | 10/1995 |
| JP | 2003103089 | A | 4/2003 |
| KR | 20040091264 | A | 10/2004 |

*Primary Examiner* — Spencer E Bell

(57) ABSTRACT

A tub ring mountable to an upper end of a liquid holding tub in a laundry treating appliance may include a circumferential side wall, a top wall extending radially inward from the side wall, and a plurality of radial stiffening ribs extending between the top wall and the side wall. The ribs may have a bottom edge with at least a portion inclined relative to horizontal. At least a portion of the bottom edge may also be complementary to a top wall of a balance ring.

10 Claims, 9 Drawing Sheets

LAUNDRY TREATING APPLIANCE WITH A TUB RING

BACKGROUND

Laundry treating appliances, such as washing machines, clothes dryers, refreshers, and non-aqueous systems, may have a configuration based on a rotating basket that defines a treating chamber in which laundry items are placed for treating. In a vertical axis washing machine having a basket and a tub, both the basket and tub typically have an upper opening at their respective upper ends. A balance ring can be coupled with the upper end of the basket to counterbalance a load imbalance that may occur within the treating chamber during a cycle of operation. A tub ring extending from the upper end of the tub can be provided for hiding the balance ring from view and preventing the user from accidentally placing clothes between the tub and the basket during loading of the laundry items.

BRIEF SUMMARY

A laundry treating appliance according to one embodiment may comprise a tub having a peripheral wall terminating in an upper edge defining an opening to an interior of the tub for holding liquid; a basket located at least partially within the interior of the tub and having a peripheral wall terminating in an upper edge defining an opening to an interior of the basket for receiving laundry for treatment; a balance ring mounted to the upper edge of the basket and having a top wall with at least a portion inclined relative to horizontal; and a tub ring having a circumferential side wall mounted to the upper edge of the tub, a top wall overlying at least a portion of the balance ring top wall, and a plurality of stiffening ribs extending between the side wall and the top wall and having a bottom edge at least partially complementary to the top wall of the balance ring.

A tub ring mountable to an upper end of a liquid holding tub in a laundry treating appliance may comprise a circumferential side wall; a top wall extending radially inward from the side wall; and a plurality of radial stiffening ribs extending between the top wall and the side wall, the ribs having a bottom edge with at least a portion inclined relative to horizontal.

DETAILED DESCRIPTION

Figure 1:
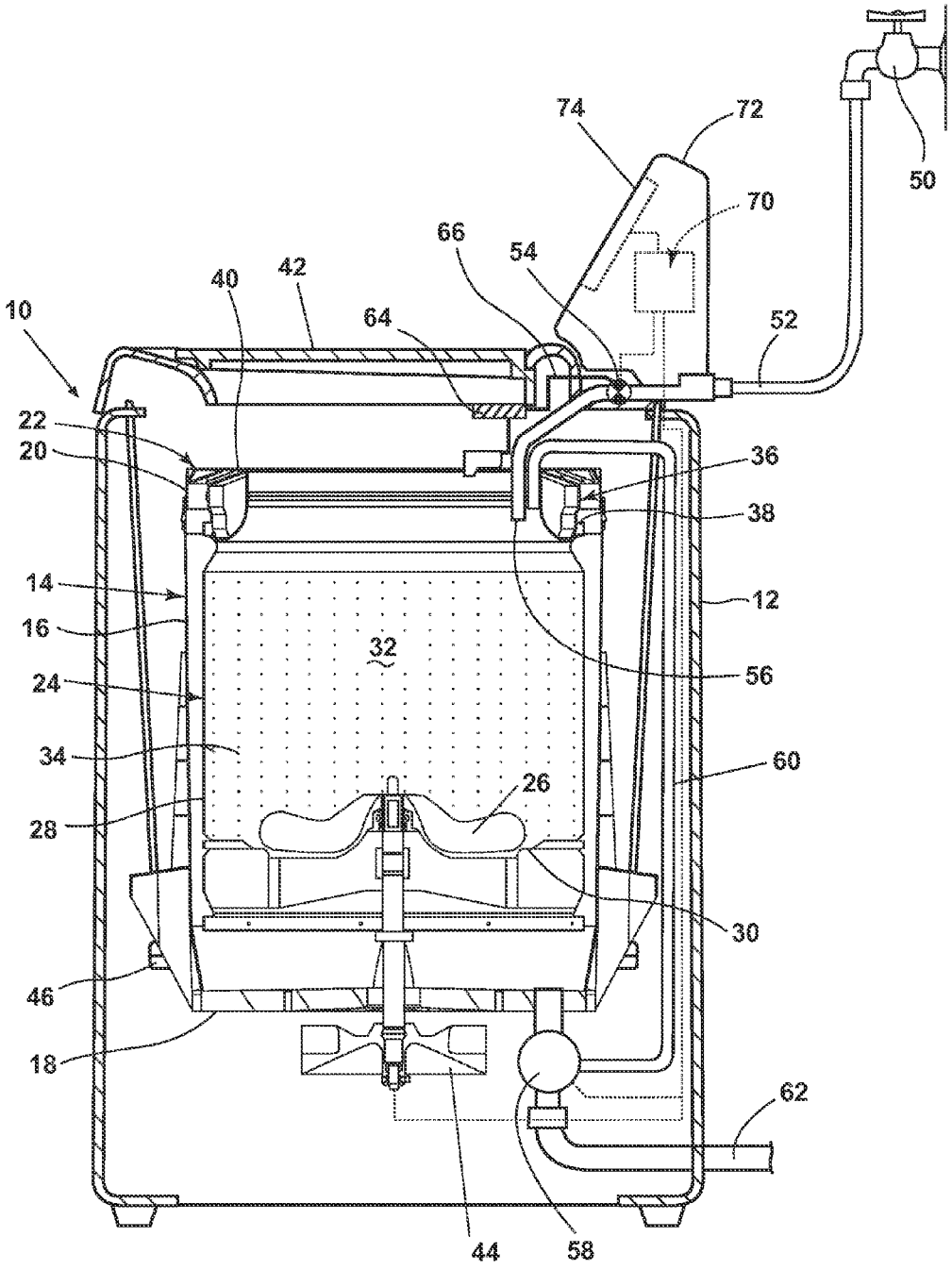
FIG. 1 is a schematic sectional view of a laundry treating appliance in the form of a washing machine.

FIG. 1 is a schematic view of a laundry treating appliance according to an exemplary embodiment. The laundry treating appliance may be any appliance that performs a cycle of operation to clean or otherwise treat items placed therein, non-limiting examples of which include a horizontal or vertical axis clothes washing machine, a combination washing machine and dryer, a tumbling or stationary refreshing/revitalizing machine, an extractor, a non-aqueous washing apparatus, and a revitalizing machine.

The laundry treating appliance of FIG. 1 is illustrated as a vertical axis washing machine 10, which may include a structural support system comprising a cabinet 12 that defines a housing within which a laundry holding system resides. The cabinet 12 may be a housing having a chassis and/or a frame, defining an interior receiving components typically found in a conventional washing machine, such as motors, pumps, fluid lines, controls, sensors, transducers, and the like. Such components will not be described further herein except as necessary for a complete understanding of the invention.

The laundry holding system of the illustrated exemplary washing machine 10 may include a watertight tub 14 installed in the cabinet 12. The tub 14 may have a generally cylindrical side or peripheral wall 16 closed at its bottom end by a base 18 that may at least partially define a sump. An upper edge 20 of the peripheral wall 16 may define an opening to an interior of the tub 14 for holding liquid, and a tub ring 22 may be mounted to the tub 14 at or near the upper edge 20. A perforated basket 24 may be mounted in the tub 14 for rotation about an axis of rotation, such as, for example, a central, vertical axis extending through the center of a laundry mover 26 in the form of an impeller, as an example, located within the basket 24. Other exemplary types of laundry movers include, but are not limited to, an agitator, a wobble plate, and a hybrid impeller/agitator. The basket 24 may have a generally cylindrical side or peripheral wall 28 closed at its bottom end by a base 30 to form an interior at least partially defining a laundry treating chamber 32 receiving a load of laundry items for treatment. The peripheral wall 28 may include a plurality of perforations or apertures 34 such that liquid supplied to the basket 24 may flow through the perforations 34 to the tub 14. A balance ring 36 may be coupled with an upper edge 38 of the basket peripheral wall 28 to counterbalance a load imbalance that may occur within the treating chamber 32 during a cycle of operation. While the washing machine 10 may employ any type of balance ring 36, an exemplary balance ring is disclosed in U.S. Patent Application Publication No. US20110247373, filed Jan. 31, 2011, whose disclosure is incorporated by reference in its entirety. The illustrated balance ring 36 may include a chamfered or inclined top wall 40 on an upper portion of the balance ring 36. The chamfer or incline of the top wall 40 may be approximately 35 degrees from a horizontal plane. As illustrated, the entire top wall 40 is inclined, but it is contemplated that alternatively only a portion of the top wall 40 is inclined relative to the horizontal, as shown and described in the aforementioned and incorporated '373 publication. The top of the cabinet 12 may include a selectively openable lid 42 to provide access into the laundry treating chamber 32 through an open top of the basket 24.

A drive system including a drive motor 44, which may or may not include a gear case, may be utilized to rotate the basket 24 and the laundry mover 26. The motor 44 may rotate the basket 24 at various speeds, including at a spin speed wherein a centrifugal force at the inner surface of the basket peripheral wall 28 is 1 g or greater; spin speeds are commonly known for use in extracting liquid from the laundry items in the basket 24, such as after a wash or rinse step in a treating cycle of operation. The motor 44 may also oscillate or rotate the laundry mover 26 about its axis of rotation during a cycle of operation in order to provide movement to the load contained within the laundry treating chamber 32. The illustrated drive system for the basket 24 and the laundry mover 26 is provided for exemplary purposes only and is not limited to that shown in the drawings and described above; the particular drive system is not germane to the invention.

A suspension system 46 may dynamically hold the tub 14 within the cabinet 12. The suspension system 46 may dissipate a determined degree of vibratory energy generated by the rotation of the basket 24 and/or the laundry mover 26 during a treating cycle of operation. Together, the tub 14, the basket 24, and any contents of the basket 24, such as liquid and laundry items, define a suspended mass for the suspension system 46. The suspension system 46 may be any type of suspension system and is not germane to the invention.

The washing machine 10 may be fluidly connected to a liquid supply 50 through a liquid supply system including a liquid supply conduit 52 having a valve assembly 54 that may be operated to selectively deliver liquid, such as water, to the tub 14 through a liquid supply outlet 56, which is shown by example as being positioned at one side of the tub 14. The washing machine 10 may further include a recirculation and drain system having a pump assembly 58 that may pump liquid from the tub 14 back into the tub 14 through a recirculation conduit 60 for recirculation of the liquid and/or to a drain conduit 62 to drain the liquid from the machine 10. The illustrated liquid supply system and recirculation and drain system for the washing machine 10 are provided for exemplary purposes only and are not limited to those shown in the drawings and described above; the particular liquid supply system and recirculation and drain system are not germane to the invention.

The washing machine 10 may also be provided with a dispensing system for dispensing treating chemistry to the basket 24, either directly or mixed with water from the liquid supply system, for use in treating the laundry according to a cycle of operation. The dispensing system may include a dispenser 64 which may be a single use dispenser, a bulk dispenser, or a combination of a single use and bulk dispenser. Water may be supplied to the dispenser 64 from the liquid supply conduit 52 by directing the valve assembly 54 to direct the flow of water to the dispenser 64 through a dispensing supply conduit 66.

The washing machine 10 may also be provided with a heating system (not shown) to heat liquid provided to the treating chamber 32. In one example, the heating system can include a heating element provided in the sump 18 to heat liquid that collects in the sump 18. Alternatively, the heating system may be in the form of an in-line heater that heats the liquid as it flows through the liquid supply, dispensing and/or recirculation systems.

The liquid supply, dispensing, and recirculation and drain systems may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry. For example, the liquid supply system and/or the dispensing system may be configured to supply liquid into the interior of the tub 14 not occupied by the basket 24 such that liquid may be supplied directly to the tub 14 without having to travel through the basket 24.

The washing machine 10 may further include a control system for controlling the operation of the washing machine 10 to implement one or more treating cycles of operation. The control system may include a controller 70 located within a console 72 or elsewhere, such as within the cabinet 12, and a user interface 74 that is operably coupled with the controller 70. The user interface 74 may include one or more knobs, dials, switches, displays, touch screens and the like for communicating with the user, such as to receive input and provide output. The user may enter different types of information including, without limitation, cycle selection and cycle parameters, such as cycle options.

The controller 70 may include the machine controller and any additional controllers provided for controlling any of the components of the washing machine 10. For example, the controller 70 may include the machine controller and a motor controller. Many known types of controllers may be used for the controller 70. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
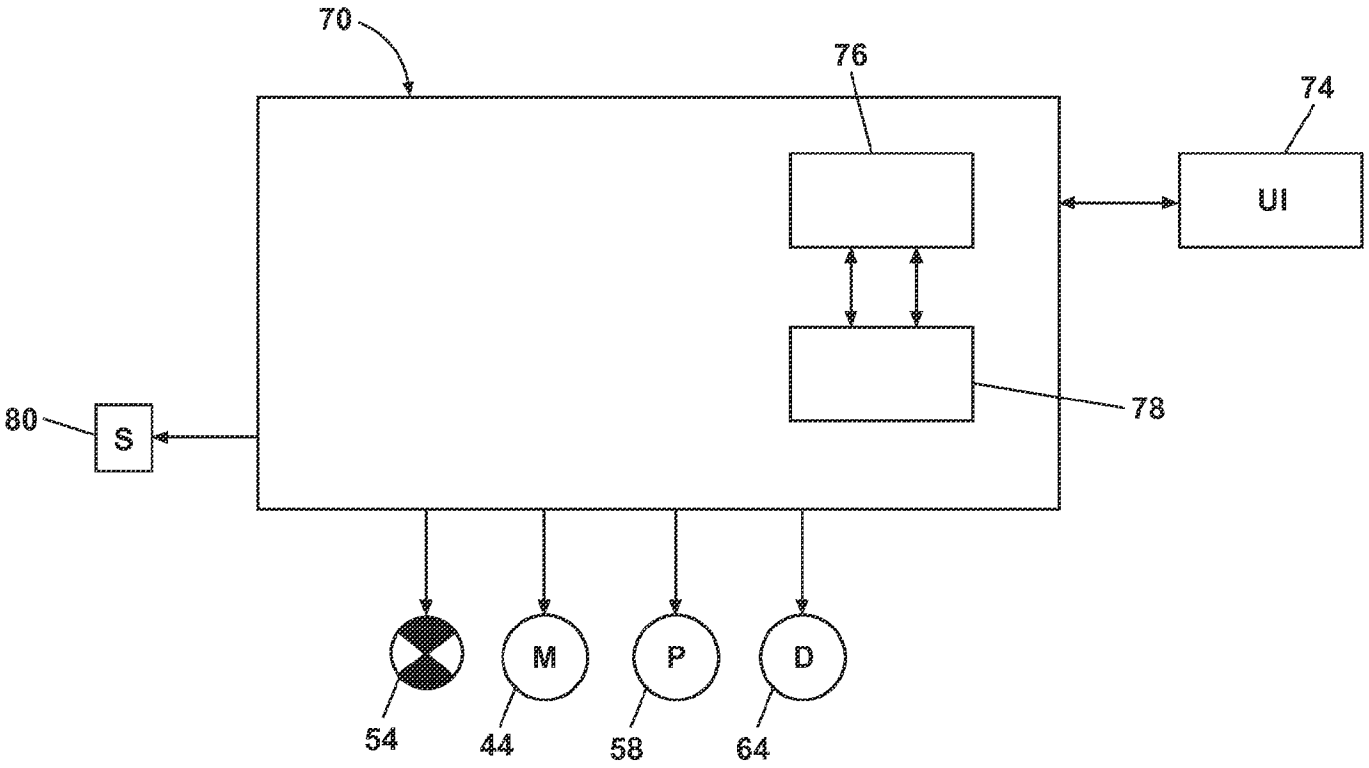
FIG. 2 is a schematic view of a control system for the laundry treating appliance of FIG. 1.

As illustrated in FIG. 2, the controller 70 may be provided with a memory 76 and a central processing unit (CPU) 78. The memory 76 may be used for storing the control software that is executed by the CPU 78 in completing a treating cycle of operation using the washing machine 10 and any additional software. Examples, without limitation, of treating cycles of operation include: wash, heavy duty wash, delicate wash, quick wash, pre-wash, refresh, rinse only, and timed wash. The memory 76 may also be used to store information, such as a database or table, and to store data received from one or more components of the washing machine 10 that may be communicably coupled with the controller 70. The database or table may be used to store the various operating parameters for the one or more cycles of operation, including factory default values for the operating parameters and any adjustments to them by the control system or by user input.

The controller 70 may be operably coupled with one or more components of the washing machine 10 for communicating with and controlling the operation of the component to complete a cycle of operation. For example, the controller 70 may be operably coupled with the motor 44, the valve assembly 54, the pump 58, the dispenser 64, and any other additional components that may be present such as a steam generator and/or a sump heater (not shown) to control the operation of these and other components to implement one or more of the cycles of operation. The controller 70 may also be coupled with one or more sensors 80 provided in one or more of the systems of the washing machine 10 to receive input from the sensors, which are known in the art and not shown for simplicity.

Figure 3:
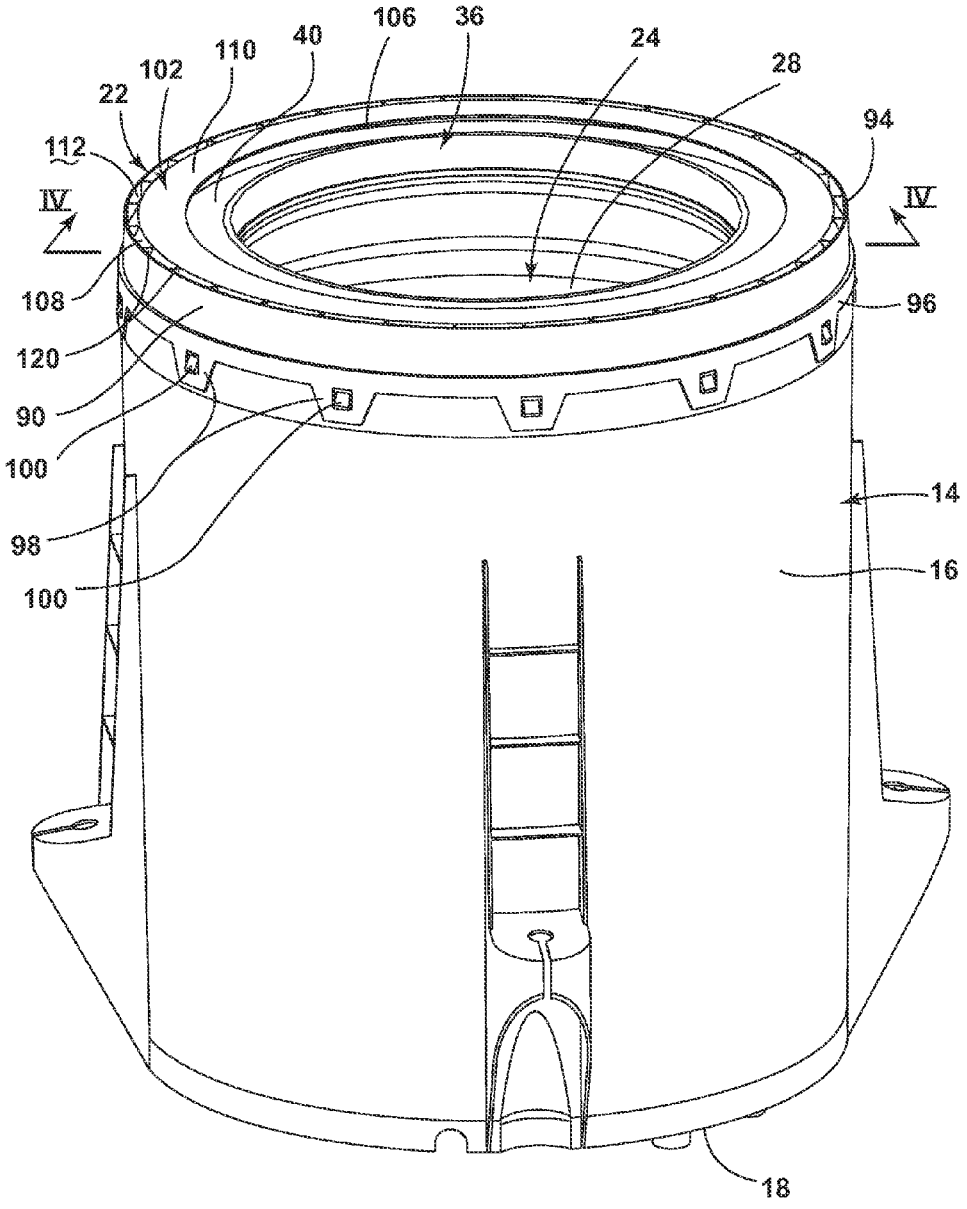
FIG. 3 is a perspective view of a tub with a tub ring and basket with a balance ring for the laundry treating appliance of FIG. 1 according to one embodiment.

Referring now to FIG. 3, which is a perspective view of the tub 14 with the tub ring 22 and the basket 24 with the balance ring 36, the tub ring 22 is annular and has a generally circular configuration in accordance with the peripheral wall of the tub 14. As best seen in the sectional view of FIG. 4, the tub ring 22 covers at least a portion of the balance ring 36 and prevents accidental loading of laundry into the space between the tub 14 and the basket 24.

Figure 4:
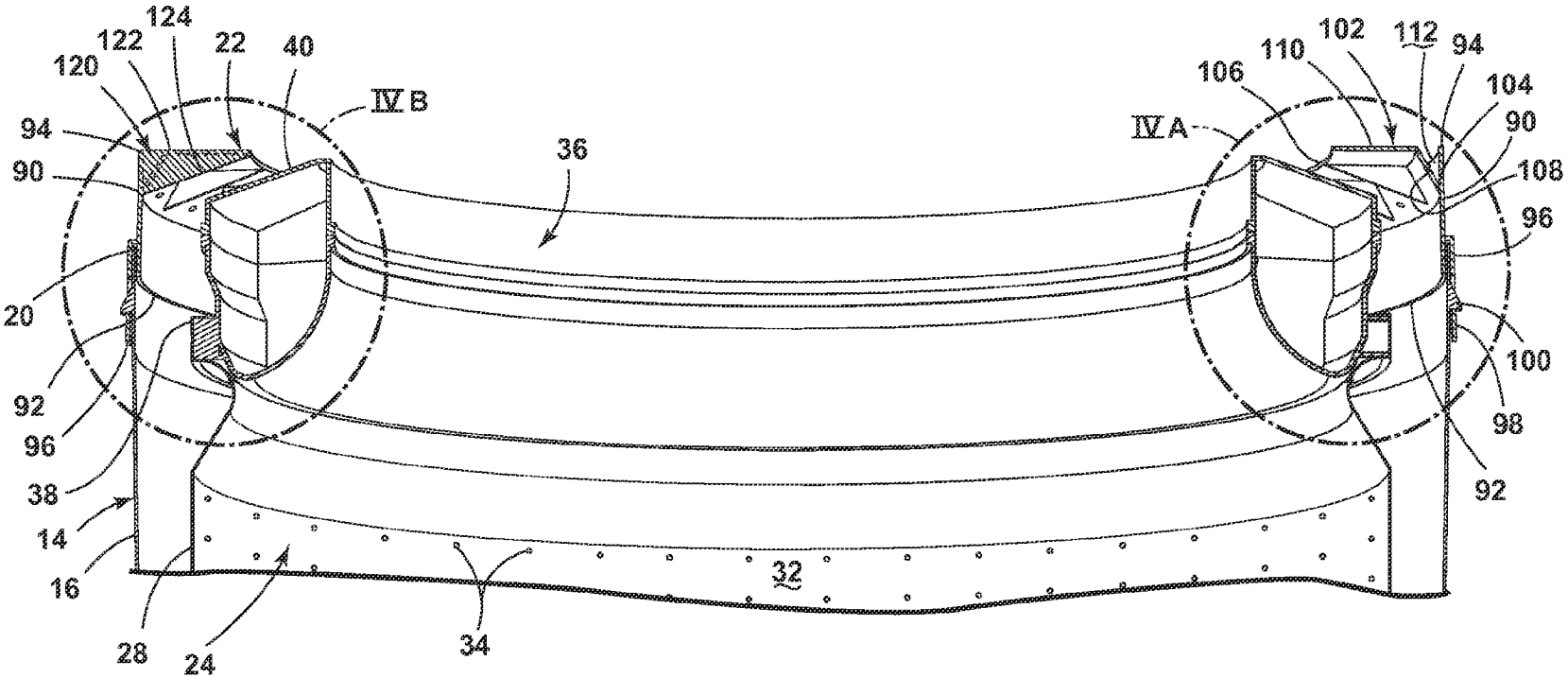
FIG. 4 is a sectional view taken along line IV-IV of FIG. 3.
Figure 4A:
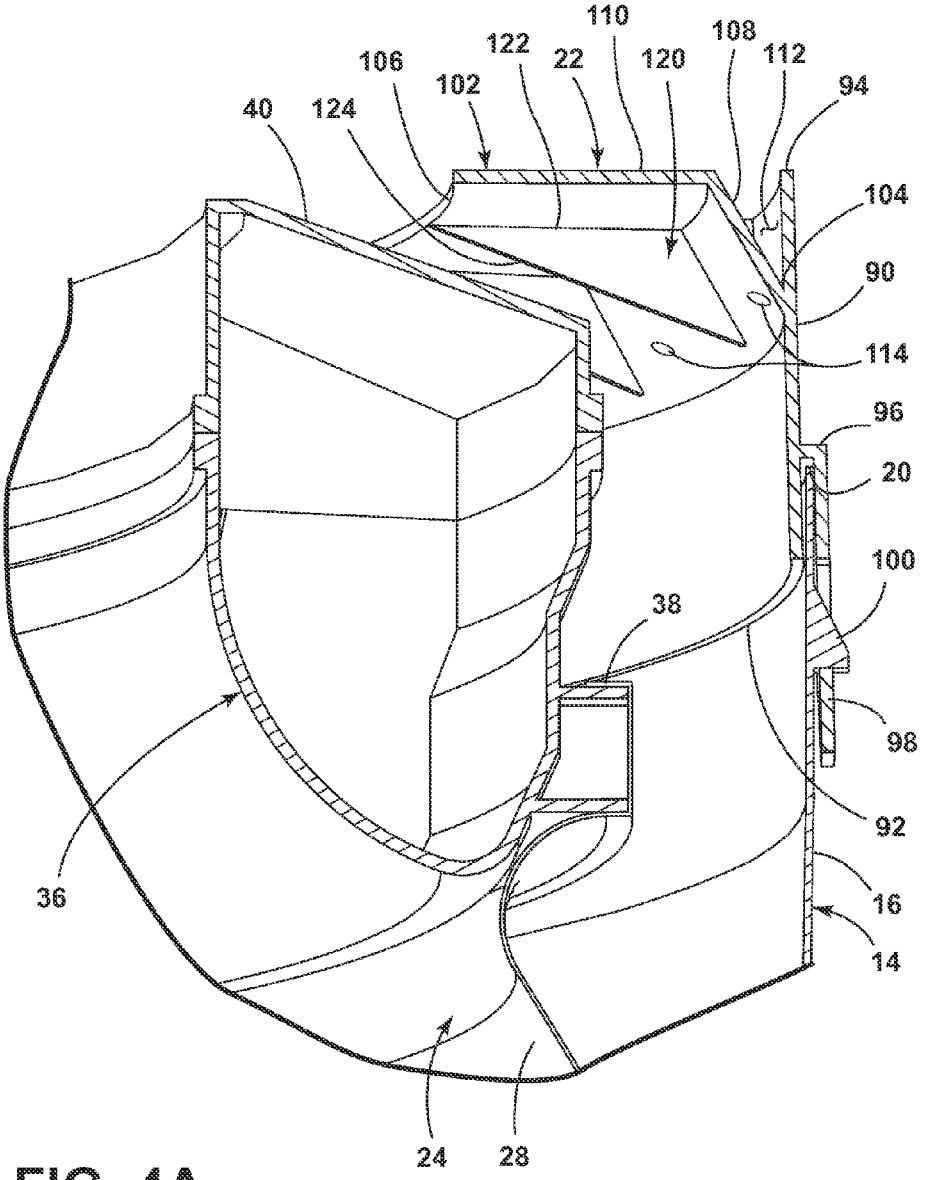
FIGS. 4A and 4B are enlarged views of the regions labeled IV-A and IV-B, respectively, in FIG. 4.

FIG. 4A provides an enlarged view of the right side of the rub ring 22 (with respect to the orientation of FIG. 4). The tub ring 22 includes a circumferential side wall 90 that may extend in a generally vertical direction between a lower end 92 and an upper end 94. An L-shaped lip 96 may extend radially outward and downward from the side wall 90 at a location near the lower end 92 so as to form, with the side wall 90, a downwardly facing slot sized to receive the tub upper edge 20. The lip 96 may extend circumferentially around the entire tub ring 22 for receipt of the entire upper edge 20 of the tub 14, if desired. A plurality of circumferentially spaced tabs 98 (also seen in FIG. 3) depending from the lip 96 may be configured to receive corresponding circumferentially spaced detents 100 or other mating structures on the tub 14 to mount and secure the tub ring 22 to the tub 14.

A top wall 102 of the tub ring 22 extends radially inward from an outer edge 104, where the top wall 102 joins the side wall 90, to an inner edge 106 a distance sufficient to overlie at least a portion of the balance ring top wall 40. In the illustrated embodiment, the top wall 102 includes an inclined portion 108 that begins at the outer edge 104 and transitions to a generally horizontal or flat portion 110 that terminates at the inner edge 106. The outer edge 104 may be spaced a distance below the upper end 94 of the side wall 90 so as to form an open-top V-shaped channel 112, defined between the side wall 90 and the top wall inclined portion 108, around the tub ring 22 adjacent the top wall flat portion 110 (also shown in FIG. 3). The channel 112 advantageously may catch liquid that splashes onto the top wall flat portion 110, and the liquid may drain downward into the tub 14. To facilitate draining, the inclined portion 108 of the top wall 102 may include drainage openings 114 at or near the bottom of the channel 112. The drainage openings 114 may be configured to direct the drained liquid into the space between the tub 14 and the basket 24. In contrast, liquid splashed onto a tub ring without such a channel may spill over the tub ring and down the side of the tub 14 onto the floor upon which the washing machine 10 rests.

Figure 4B:
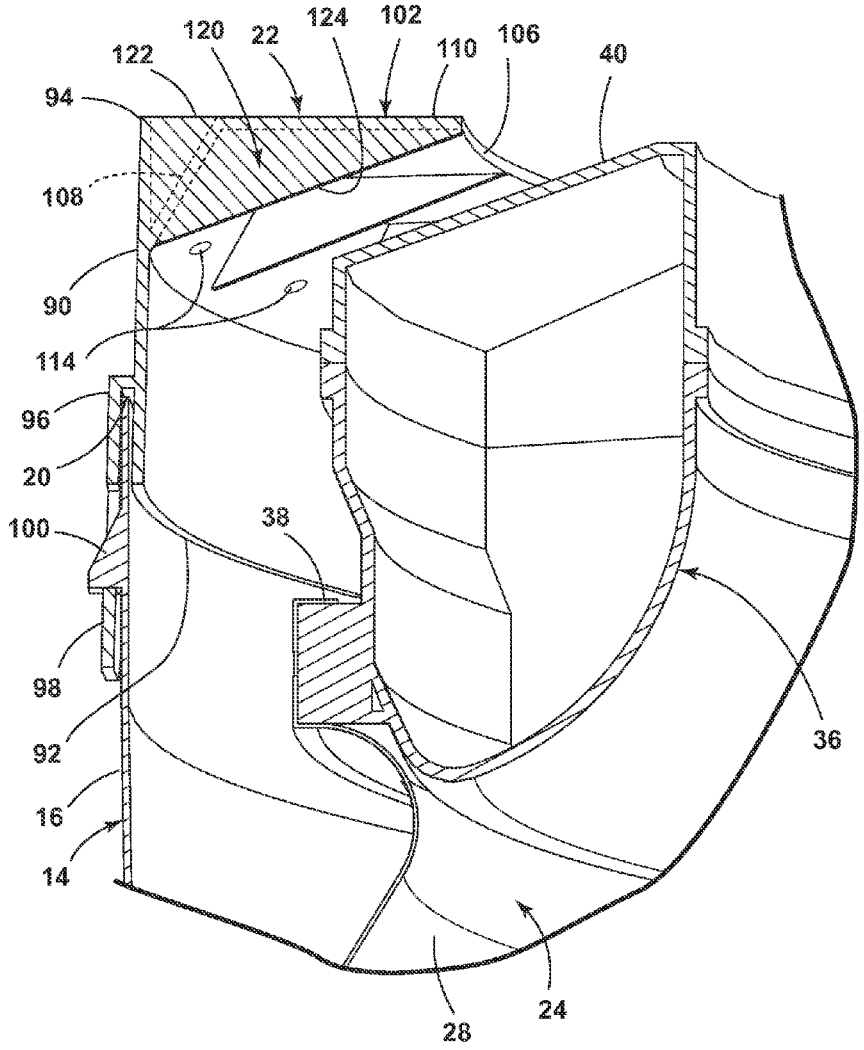

As seen in FIG. 4B, which is an enlarged view of the left of the rub ring 22 (with respect to the orientation of FIG. 4), a plurality of radial ribs 120 may be circumferentially spaced around the tub ring 22. The ribs 120 generally extend between the side wall 90 and the top wall 102 of the tub ring 22 to stiffen the tub ring 22 and thereby reduce the likelihood of the tub ring buckling. In particular, each rib 120 extends radially inward from side wall 90 through the channel 112, passes through the inclined portion 108 (shown in phantom) of the top wall 102, extends along the flat portion 110 of the top wall 102, and terminates at or near the top wall inner edge 106. A top edge 122 of the rib 120 joins with the top wall flat portion 110, except for a portion that is exposed in the area between the side wall 90 and the top wall flat portion 110 (i.e., the region of the inclined portion 108). A bottom edge 124 of the rib 120, or at least a portion thereof, may be inclined in a manner similar to the top wall 40 of the balance ring 36 so as to be complementary to the balance ring top wall 40. In the illustrated embodiment, the entire bottom edge 124 is inclined upward along a direction moving radially inward from the side wall 90, and the ribs 120 each have a generally triangular configuration, specifically a right-triangular configuration with the bottom edge 124 forming the hypotenuse of the triangle.

Figure 5:
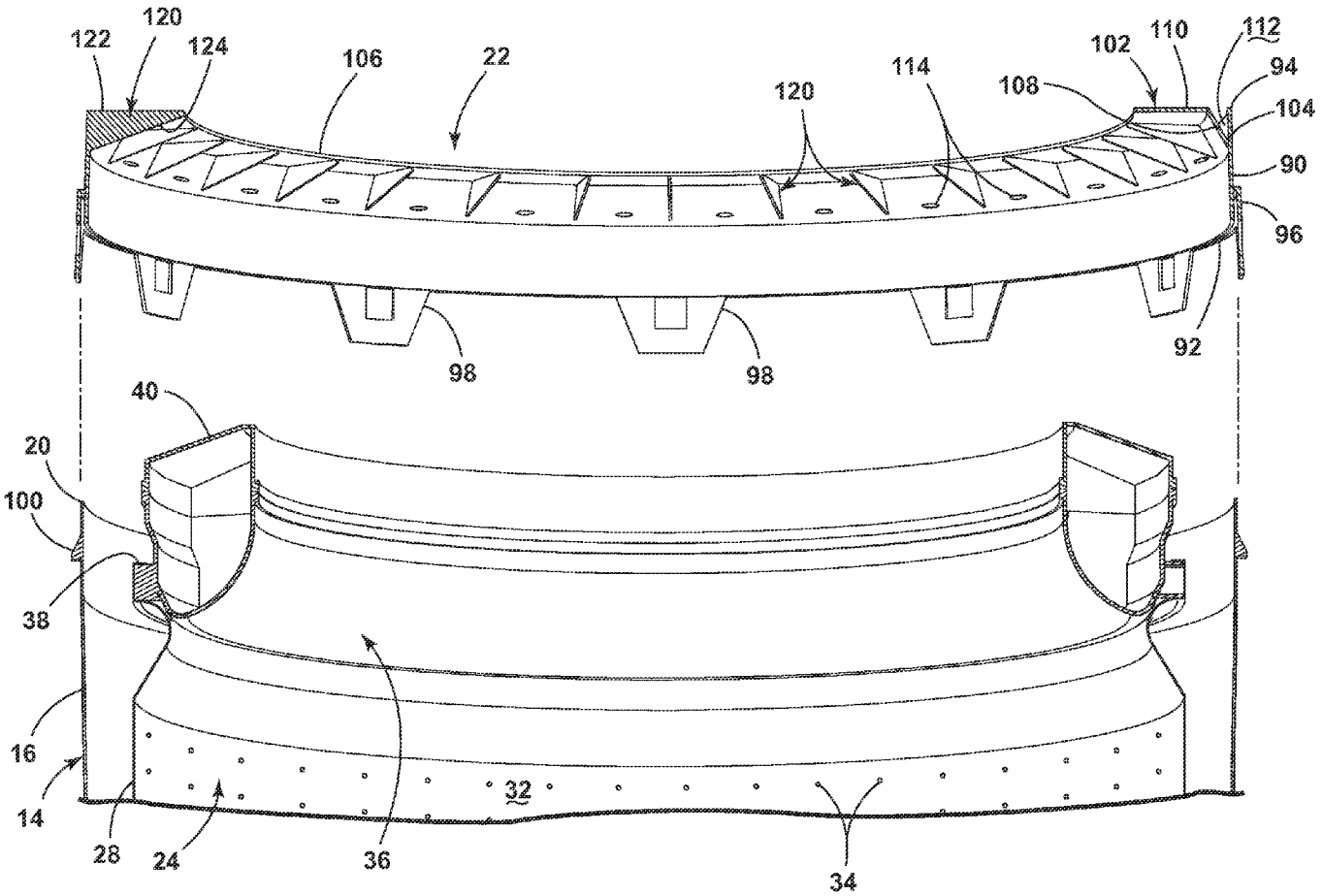
FIG. 5 is a sectional view similar to FIG. 4 with the tub ring exploded from the tub.

Referring now to FIG. 5, which is similar to FIG. 4 but with the tub ring 22 shown exploded from the tub 14, the ribs 120 may be disposed around the entire tub ring 22, half of which can be seen in FIG. 5. Any suitable number of ribs 120 may be spaced around the tub ring 22 to provide a desired stiffness, and the illustrated tub ring 22, as an example, includes about 32 of the ribs 120 with a spacing of about 65 mm (2.5 in.) between adjacent ribs. As an example, the bottom edge 124 of the rib 120 is inclined at about 35 degrees to complement the balance ring top wall 40. While the rib bottom edge 124 and the balance ring top wall 40 may have identical angles of inclination, it is not necessary for the inclination angles to match exactly to be complementary.

The flat disc configuration of the top wall 102 provides resistance to ovalization of the tub ring 22 during high speed rotation of the basket 24, such as during spinning, and the ribs 120 extending between the side wall 90 and the top wall 102 increase stiffness to resist buckling. Such a design increases the natural frequency of the suspended mass, which, in turn, permits an increase in maximum spin speed. For example, a natural frequency increase of about 2 Hz, which is a reasonable increase for the tub ring 22, would allow the maximum spin speed to be increased as much as about 120 rpm for a basket having a diameter of about 63 cm (24.8 in.). The actual amount of maximum spin speed increase can be a function of several factors, including the size of the basket 24. These performance benefits are realized without sacrificing capacity of the basket 24 as a result of the complementary inclined portions of the tub ring rib bottom edge 124 and the balance ring top wall 40. In comparison, if the balance ring top wall 40 were flat or horizontal by raising the outer edge of the of the balance ring top wall 40, the tub ring top wall 102 would need to be shifted upwards (i.e., increase the vertical height of the side wall 90) to provide sufficient spacing between the balance ring top wall 40 and the ribs 120. Increasing the vertical height of the side wall 90 consumes valuable vertical space within the cabinet 12, which is typically limited to industry standard sizing, which depends on several factors, because it can necessitate a reduction in the vertical height of the basket 24 and, thus, cause a decrease in load capacity. However, the ribs 120 of the tub ring 22 illustrated above provide needed structural rigidity while fitting nicely into the space formed between the inclined balance ring top wall 40 and the tub ring top wall 102 without having to increase the vertical height of the side wall 90.

Figure 6:
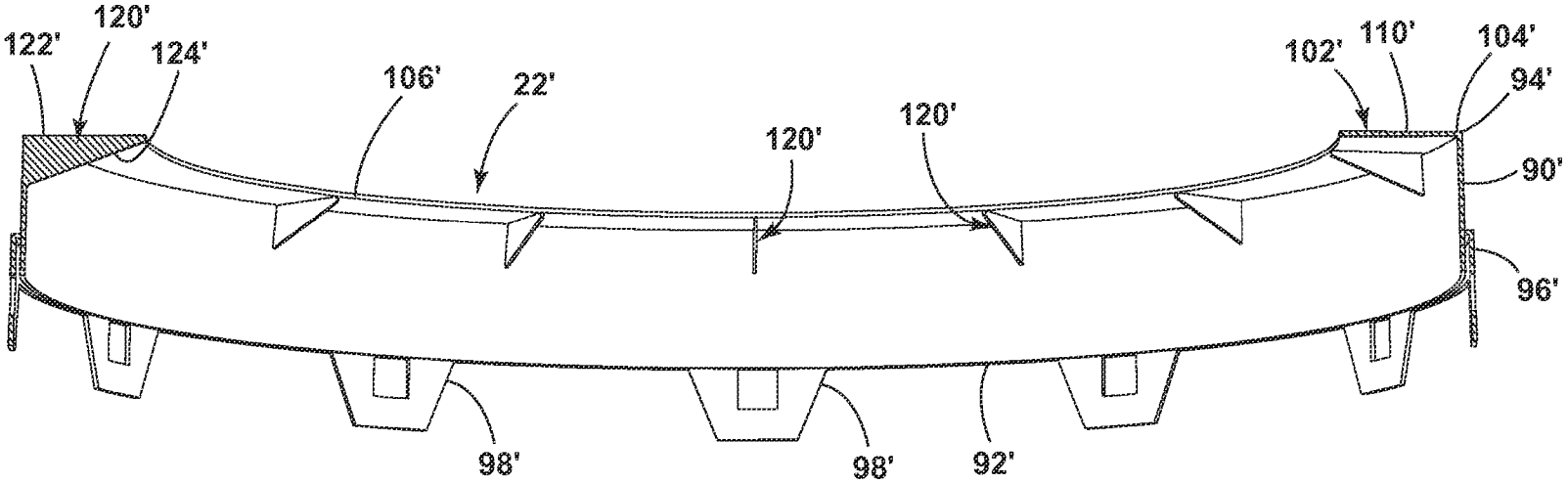
FIG. 6 is a sectional view of a tub ring according to an alternative embodiment.

FIG. 6 presents a perspective view of an alternative embodiment of the tub ring 22', where elements similar to those in the previous embodiment are identified with the same reference numeral bearing a prime symbol ('). The tub ring 22' is substantially identical to the tub ring 22 in FIGS. 3-5, except that the top wall 102' includes only the flat portion 110', which joins to the side wall 90' in a generally perpendicular configuration, by example, at the upper end 94' of the side wall 90'. Consequently, the top edges 122' of the ribs 120' are completely covered by the top wall 102' as they extend radially inward from the side wall 90'.

Figure 7:
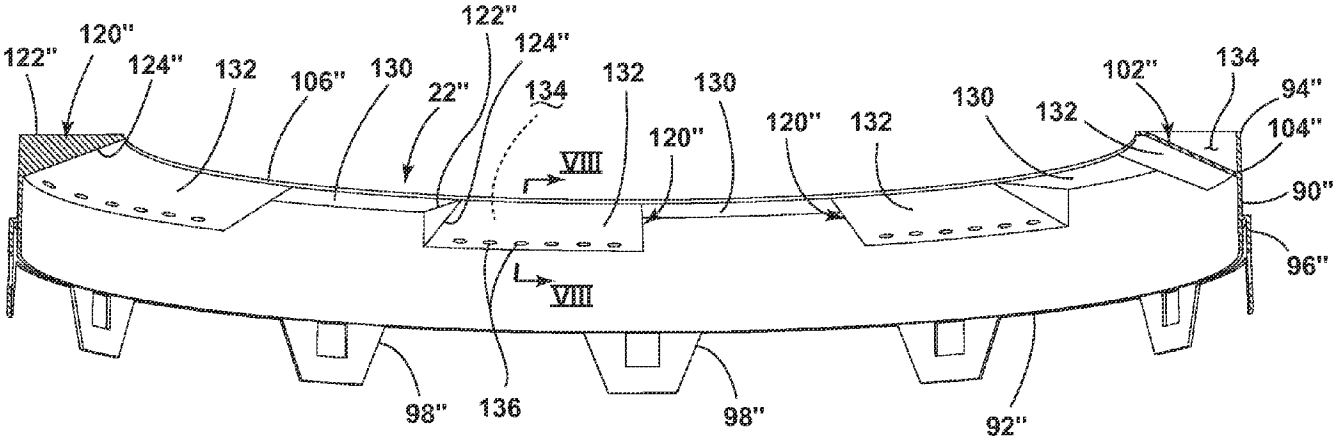
FIG. 7 is a sectional view of a tub ring according to another alternative embodiment.

FIG. 7 presents a perspective view of another alternative embodiment of the tub ring 22", where elements similar to those in the previous embodiments are identified with the same reference numeral bearing a double prime symbol ("). The tub ring 22" is substantially identical to the tub ring 22' in FIG. 6, except that the top wall 102" is formed by flat sections 130 and inclined sections 132 that alternate circumferentially around the tub ring 22". The flat sections 130 have the same general configuration as the top wall 102' in FIG. 6 and extend circumferentially between adjacent ribs 120", connecting the top edges 122" of the adjacent ribs 120". The inclined sections 132 extend radially inward from the side wall 90", just like the flat sections 130, but the outer edge 104" joins with the side wall 90" at a location shifted downward from the upper end 94" a distance about equal to the height of the rib 120" at its connection to the side wall 90". The inclined sections 132 may be inclined upward, moving radially inward, at an angle substantially equal to the inclination angle of the rib bottom edge 124", connecting the bottom edges 124" of adjacent ribs 120". Because the flat and inclined sections 130, 132 alternate circumferentially, each rib 120" joins to one of the flat sections 130 at the top edge 122" and to one of the inclined sections 132' at the lower edge 124". Consequently, as one moves circumferentially around the tub ring 22", the top wall 102" transitions between the flat sections 130 and the inclined sections 132 at the ribs 120", and the ribs 120" can be considered as steps for the top wall 102". For example, starting at a flat section 130, a first rib 120" is a step down as the top wall 102" transitions from the flat section 130 to an inclined section 132, then a second rib 120" is a step up as the inclined section 132 transitions to the next flat section 130, then a third rib 120" is a step down as that flat section 130 transitions to the next inclined section 132, and so on.

Figure 8:
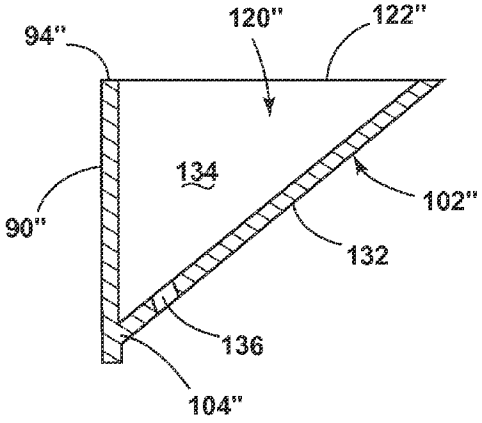
FIG. 8 is a sectional view taken along line VII-VII of FIG. 7.

The configuration of the top wall 102" in the embodiment of FIG. 7 facilitates formation of one or more treating chemistry cavities in the tub ring 22". For example, the area bounded by two adjacent ribs 120", the side wall 90" between the adjacent ribs 120", and one of the inclined sections 132 joining the adjacent ribs 120" may define a treating chemistry cavity 134, identified in phantom in FIG. 7 and shown more clearly in the sectional view of FIG. 8. The treating chemistry cavity 134 may be sized to receive a desired type and/or dosage of treating chemistry and may be employed in addition to or in lieu of the dispenser 64. The treating chemistry may have any form, including, but not limited to a solid block, a powder, a gel, a liquid, an encased solid, powder, liquid, etc. (i.e., a pod), and so on. The treating chemistry may be any type of treating chemistry, non-limiting examples of which include one or more of the following: water, detergents, bleach, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The inclined section 132 of the top wall 102" may include one or more apertures 136 for dispensing of the treating chemistry into the tub 14 and/or the basket 24. The size, number, pattern, and orientation of the apertures 136 may vary depending on the type and/or form of the treating chemistry and the particular location for dispensing the treating chemistry. Optionally, the apertures 136 may fluidly communicate with a conduit or similar structure for directing the treating chemistry to a particular area of the tub 14 and/or the basket 24. As another option, the treating chemistry cavity 134 may be open at the top, as in the illustrations, or may be selectively closed by a movable lid.

The tub ring may be modified in any suitable manner, including combining features of the different embodiments disclosed above as desired. For example, the tub ring may be mounted to the tub with structure other than the tabs and detents. Additionally, the bottom edges of the tub ring ribs may have only portions inclined, rather than the entire bottom edge being inclined, as shown in the Figures. As an example, the balance ring in the aforementioned and incorporated '373 publication has a top wall with only a portion thereof inclined, and the tub ring can have a bottom edge with only a portion inclined to be complementary to inclined portion of the balance ring top wall. For the embodiment with the alternating flat and inclined top wall sections, the seconds can be arranged in any desired pattern and need not be in an alternating pattern.

While the invention has been specifically described in connection with certain specific embodiments thereof, it is to be understood that this is by way of illustration and not of limitation, and the scope of the appended claims should be construed as broadly as the prior art will permit.

What is claimed is:

1. A laundry treating appliance comprising:

a tub having a peripheral wall terminating in an upper edge defining an opening to an interior of the tub for holding liquid;

a basket located at least partially within the interior of the tub and having a peripheral wall terminating in an upper edge defining an opening to an interior of the basket for receiving laundry for treatment;

a balance ring mounted to the upper edge of the basket and having a top wall with at least a portion inclined relative to horizontal and defining a top edge for the balance ring; and a tub ring having a circumferential side wall mounted to the upper edge of the tub, a top wall overlying at least a portion of the balance ring top wall and terminating at an inner edge, and a plurality of stiffening ribs extending between the side wall and the top wall of the tub ring and having a bottom edge with at least a portion inclined relative to the horizontal defining an upper edge and a lower edge for the bottom edge and arranged complementary to the top wall of the balance ring;

wherein the top edge of the balance ring is located vertically between the upper edge and the lower edge of the bottom edge of the stiffening ribs relative to the horizontal, and the top edge of the balancing ring is positioned radially interior of the inner edge of the tub ring.

2. The laundry treating appliance according to claim 1 wherein at least a portion of the bottom edge is inclined to be complementary with the inclined portion of the balance ring top wall.

3. The laundry treating appliance according to claim 2 wherein the entire bottom edge of the stiffening ribs is inclined from the tub ring side wall to the tub ring top wall.

4. The laundry treating appliance according to claim 2 wherein the tub ring top wall extends radially inward from an outer edge, where the top wall of the tub ring joins the side wall of the tub ring, to the inner edge of the top wall of the tub ring, and the stiffening ribs terminate at one end at the inner edge of the top wall of the tub ring.

5. The laundry treating appliance according to claim 1 wherein the tub ring top wall is formed by a plurality of flat sections and a plurality of inclined sections, wherein the flat sections and the inclined sections alternate circumferentially around the tub ring and transition at the stiffening ribs.

6. The laundry treating appliance according to claim 5 wherein the stiffening ribs comprise a generally horizontal top edge, at least a portion of the bottom edge is inclined, and the tub ring top wall flat sections join the top edges of adjacent stiffening ribs, and the tub ring top wall inclined sections join the bottom edges of adjacent stiffening ribs such that each stiffening rib joins to one of the flat sections at the stiffening ribs top edge and to one of the inclined sections at the stiffening ribs bottom edge for the transition from the one of the flat sections to the one of the inclined sections.

7. The laundry treating appliance according to claim 6 wherein at least one of the inclined sections, the adjacent stiffening ribs joined by the at least one of the inclined sections, and the tub ring side wall between the adjacent stiffening ribs joined by the at least one of the inclined sections form a treating chemistry cavity, and the at least one of the inclined sections includes at least one aperture that directs treating chemistry from the treating chemistry cavity into a space between the tub peripheral wall and the basket peripheral wall.

8. The laundry treating appliance according to claim 1 wherein the tub ring top wall is annular with an outer, inclined portion joined to the tub ring side wall and an inner, flat portion, and the tub ring side wall and the inclined portion form a circumferential channel extending around the tub ring adjacent to the flat portion of the tub ring top wall.

9. The laundry treating appliance according to claim 8 wherein the inclined portion of the tub ring top wall includes at least one drainage opening fluidly coupling the circumferential channel with the tub.

10. The laundry treating appliance according to claim 1 wherein the tub ring top wall is generally flat and annular and extends radially inward from the tub ring side wall generally perpendicular to the tub ring side wall.

* * * * *